United States Patent [19]

Brown et al.

[11] 4,382,047

[45] May 3, 1983

[54] CARBURETOR FOR INTERNAL COMBUSTION ENGINE

[75] Inventors: Peter W. Brown, Waukegan; Chester G. DuBois, Zion; Richard M. McChesney, Waukegan, all of Ill.

[73] Assignee: Outboard Marine Corporation, Waukegan, Ill.

[21] Appl. No.: 104,401

[22] Filed: Dec. 17, 1979

Related U.S. Application Data

[63] Continuation of Ser. No. 936,230, Aug. 24, 1978, abandoned.

[51] Int. Cl.[3] ..... F02M 7/04

[52] U.S. Cl. ..... 261/41 D; 261/DIG. 39; 261/121 A

[58] Field of Search ..... 261/41 D, 41 R, DIG. 39, 261/121 A

[56] References Cited

U.S. PATENT DOCUMENTS

| | | | |
|---|---|---|---|
| 2,103,689 | 12/1937 | Mullen, Jr. | 261/41 R |
| 2,208,317 | 7/1940 | Beck | 261/41 R |
| 2,447,264 | 8/1948 | Beardsley, Jr. . | |
| 2,590,217 | 3/1952 | Snyder et al. | 261/41 D |
| 2,649,290 | 8/1953 | Griffon . | |
| 2,810,560 | 10/1957 | Olson et al. . | |
| 2,838,293 | 6/1958 | Carlson et al. . | |
| 2,839,154 | 7/1958 | Sterner | 261/41 D |
| 2,852,240 | 9/1958 | Goodyear | 261/41 D |
| 2,985,159 | 5/1961 | Moseley . | |
| 2,989,292 | 6/1961 | Marsee . | |
| 3,066,922 | 12/1962 | Wuncherer | 261/41 R |
| 3,170,006 | 2/1965 | Brown | 261/DIG. 68 |
| 3,346,245 | 10/1967 | Mennesson | 261/39 D |
| 4,045,521 | 8/1977 | Lemonnier et al. | 261/41 R |

*Primary Examiner*—Tim R. Miles

*Attorney, Agent, or Firm*—Michael, Best & Friedrich

[57] ABSTRACT

An engine operative between a low speed, a high speed, and an intermediate speed between the low and high speeds comprises a combustion chamber and a throttle operatively connected to the engine for controlling operation of the engine between the low, intermediate, and high speeds. The engine further includes a source of fuel and a fuel delivery system communicating with the fuel source and the combustion chamber for introducing fuel into the combustion chamber in response to the throttle. The fuel delivery system comprises a first fuel metering assembly for discharging fuel into the combustion chamber when the engine is being operated at the low speed, a second fuel metering assembly independent of the first fuel metering assembly for discharging fuel into the combustion chamber when the engine is being operated at the intermediate and high speeds, and a third fuel metering assembly independent of the first and second metering assemblies for discharging into the combustion chamber fuel in addition to the fuel discharged by the second fuel metering assembly when the engine is being operated at the high speed.

6 Claims, 1 Drawing Figure

FUEL PUMP
FUEL TANK

CARBURETOR FOR INTERNAL COMBUSTION ENGINE

This is a continuation of application Ser. No. 936,230, filed Aug. 24, 1978, now abandoned.

BACKGROUND OF THE INVENTION

I. Field of the Invention

The invention relates to internal combustion engines and, more particularly, to carburetors for internal combustion engines.

II. Description of the Prior Art

Carburetors for internal combustion engines are known and disclosed in the following U.S. patents:

Beardsley, Jr.: U.S. Pat. No. 2,447,264, Aug. 17, 1948
Griffon: U.S. Pat. No. 2,649,290, Aug. 18, 1953
Olson et al: U.S. Pat. No. 2,810,560, Oct. 22, 1957
Carlson et al: U.S. Pat. No. 2,838,293, June 10, 1958
Goodyear: U.S. Pat. No. 2,852,240, Sept. 16, 1958
Moseley: U.S. Pat. No. 2,985,159, May 23, 1961
Marsee: U.S. Pat. No. 2,989,292, June 20, 1961
Wucherer: U.S. Pat. No. 3,066,922, Dec. 4, 1962

It is desirable to be able to adjust a carburetor to achieve optimum fuel economy at idle and normal cruise speeds without simulataneously sacrificing the power necessary to operate the engine at high speeds. Some of the above patents disclose fuel delivery systems which seek to balance high speed power with low and moderate speed fuel economy. However, the prior disclosed fuel delivery systems include springs and diaphragms (Beardsley), multiple throttle valves (Carlson), and multiple venturis (Goodyear, Wucherer) to achieve the objective. The prior disclosed fuel delivery systems thereby disclose complex and convoluted constructions which would require substantial structural modifications to many carburetors. None discloses a simple, yet effective, fuel delivery system for limiting and controlling optimum fuel supply throughout a range of engine speeds, which systems does not require extensive structural modifications to many existing carburetor designs.

SUMMARY OF THE INVENTION

The invention provides an engine operative at intermediate speeds between a low speed and a high speed, which engine includes a combustion chamber. Throttle means is operatively connected to the engine for controlling operation of the engine between the low, intermediate, and high speeds. The engine further includes a source of fuel and fuel delivery means communicating with the fuel source and the combustion chamber and operative for introducing fuel into the combustion chamber in response to the throttle means. The fuel delivery means comprises first fuel metering means for discharging fuel into the combustion chamber when the engine is being operated at the low speed, second fuel metering means independent of the first fuel metering means for discharging fuel to the combustion chamber when the engine is being operated at the intermediate and high speeds, and third fuel metering means independent of the first and second metering means for discharging into the combustion chamber fuel in addition to the fuel discharged by the second fuel metering means when the engine is being operated at the high speed.

In accordance with one embodiment of the invention, the fuel delivery means includes a fuel chamber communicating with the first, second and third metering means, fuel conduit means communicating with the source of fuel and the fuel chamber for carrying fuel to the fuel chamber, and fuel pumping means communicating with the fuel conduit means for pumping fuel through the fuel conduit means in response to engine operation.

In accordance with another embodiment of the invention, the fuel delivery means includes an air induction passage having an interior wall, which air induction passage includes an inlet end communicating with the atmosphere, an outlet end communicating with the combustion chamber, and a venturi located intermediate the inlet and outlet ends. In this embodiment, the throttle means includes a butterfly valve having opposite end portions, which butterfly valve is mounted in the air induction passage intermediate the venturi and the outlet port. The butterfly valve is manually operable between a substantially closed position, in which the opposite end portions are held in a close, non-touching relationship relative to the interior wall for operating the engine at the low speed, a partially open position for operating the engine at the intermediate speed, and a fully open position for operating the engine at the high speed. The first fuel metering means communicates with the air induction passage intermediate the butterfly valve and the outlet end, and is located in close proximity to one of the outer end portions of the butterfly valve when the butterfly valve is in the substantially closed position. The second fuel metering means communicates with the air induction passage at the venturi, and the third fuel metering means communicates with the air induction passage intermediate the venturi and the inlet end.

In accordance with another embodiment of the invention, the second fuel metering means includes a primary fuel supply passage having a primary inlet end communicating with the fuel chamber, and the first fuel metering means includes a branch fuel supply passage having a branch inlet end communicating with the primary fuel supply passage. Also in this embodiment, the third fuel metering means includes a tertiary fuel supply passage having a tertiary inlet end communicating with the fuel chamber.

In accordance with another embodiment of the invention, the primary fuel supply passage includes an open outlet end extending partially into the venturi and first restriction means intermediate the primary inlet end and the branch inlet end and operative for constricting the passage of fuel from the fuel chamber to the combustion chamber when the engine is being operated at the low speed while permitting the passage of fuel from the fuel chamber to the combustion chamber when the engine is being operated at the intermediate and high speeds. In this embodiment, the branch fuel supply passage includes a restricted outlet end located in the interior wall, and second restriction means at the branch inlet end, which second restriction means is operative in combination with the first restriction means and the restricted outlet end, for permitting the passage of fuel from the fuel chamber to the combustion chamber when the engine is being operated at the low speed while constricting the passage of fuel from the fuel chamber to the combustion chamber when the engine is being operated at the intermediate and high speeds.

In accordance with another embodiment, the tertiary fuel supply passage includes a restricted tertiary outlet end extending partially into the air induction passage and air bleed means operative in combination with the restricted tertiary outlet end for constricting the passage of fuel from the fuel chamber to the combustion chamber when the engine is being operated at the intermediate and low speeds while permitting the passage of fuel from the fuel chamber to the combustion chamber when the engine is being operated at the high speed.

In accordance with another embodiment of the invention, the air bleed means includes at least one small aperture in the tertiary fuel supply passage intermediate the tertiary inlet end and the restricted tertiary outlet end, which aperture is adapted to partially vent the tertiary supply passage to the atmosphere. In this embodiment, the restricted tertiary outlet end includes a nozzle having a fuel discharge opening near the venturi.

One of the principal features of the invention is the provision of an engine having first, second and third fuel metering means, which multiple fuel metering means assures optimum fuel economy without sacrificing power throughout a wide range of engine speeds.

Another of the principal features of the invention is the provision of an engine having first, second, and third fuel metering means, which multiple metering means operates simply and effectively and does not require extensive structural modifications to many existing carburetor designs.

Other features and advantages of the embodiments of the invention will become apparent upon reviewing the following general description, the drawings and the appended claims.

Figure 1:
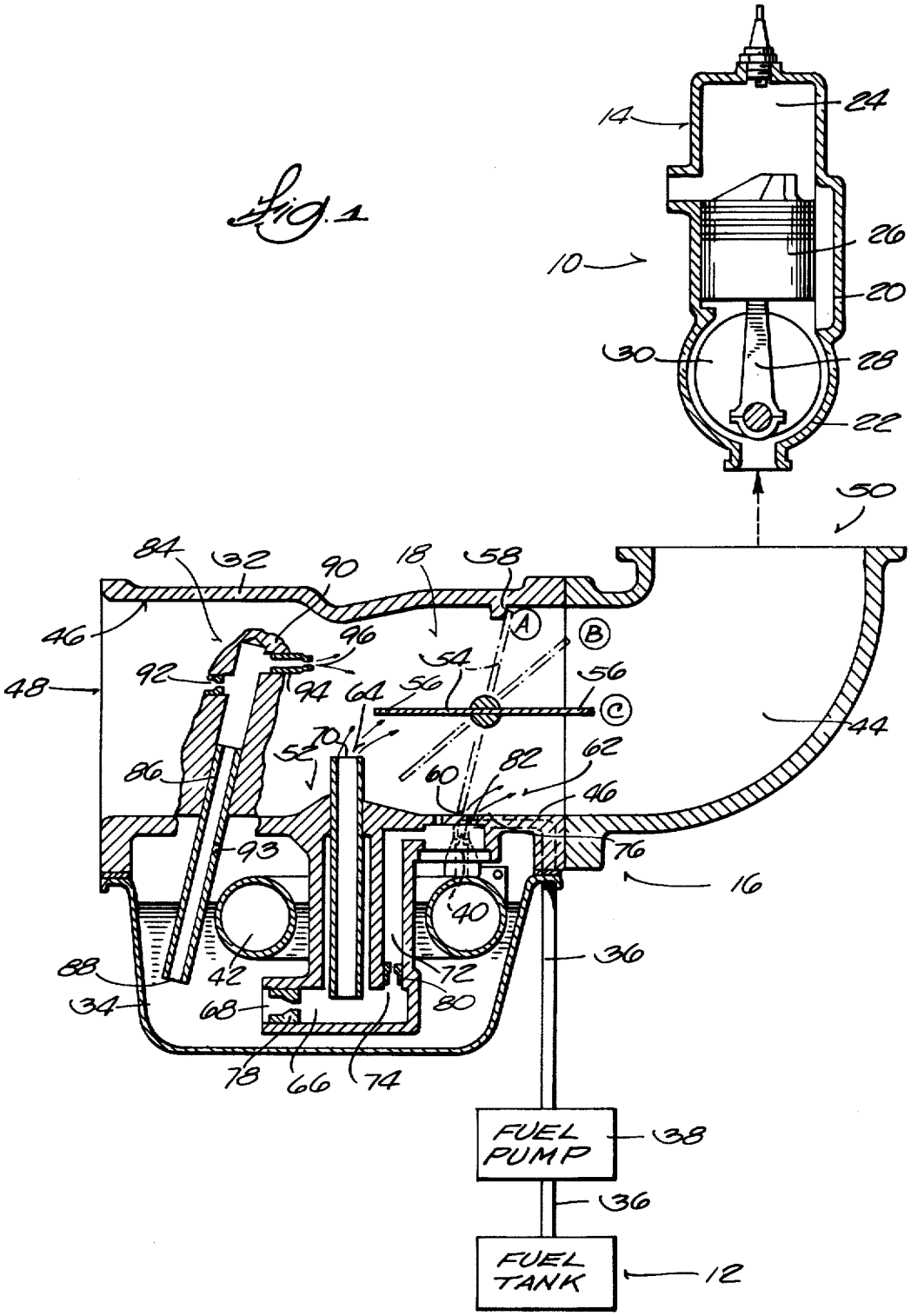
FIG. 1 is a fragmentary and partially diagrammatic view of an engine embodying various of the features of the invention.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein for the purpose of description should not be regarded as limiting.

GENERAL DESCRIPTION

Shown in FIG. 1 is an internal combustion engine 10 which includes a source 12 of fuel, a combustion chamber 24, and fuel delivery means 16 communicating with the source 12 and the combustion chamber 24. The engine 10 is operative between a low or idle speed and a high or full power speed, and includes an intermediate speed range between the low and high speeds. Throttle means 18 is operatively connected with the engine 10 for controlling the engine speed, and the fuel delivery means 16 is operative for introducing fuel into the combustion chamber 24 in response to the throttle means 18.

While various engine constructions can be used, in the illustrated embodiment, the combustion chamber 24 includes a block member 20 defining a crankcase 22 and a cylinder 14 extending from the crankcase 22. A piston 26 is mounted for reciprocative movement inside the cylinder 14 and is connected by a connecting rod 28 to a crankshaft 30 rotatably mounted in the crankcase 22. The reciprocative movement of the piston 26 in the cylinder 14 creates a series of pulsating pressure variations in the crankcase 22.

The fuel delivery means 16 can be variously constructed. In the illustrated embodiment, a carburetor 32 includes a float-type fuel chamber 34. A fuel conduit 36 communicates with the source 12 of fuel and the fuel chamber 34 for carrying fuel to the fuel chamber 34, and a fuel pumping means, such as a mechanical or pulse activated fuel pump 38, is connected in line with the fuel conduit 36 for pumping fuel into the fuel chamber 34 in response to piston 26 reciprocation. A needle valve 40 is operatively connected to a float 42 carried within the fuel chamber 34, such that, as fuel enters the fuel chamber 34, the float 42 rises and eventually seats the needle valve 40, thereby preventing the further flow of fuel into the fuel chamber 34. In similar fashion, as fuel is drawn from the fuel chamber 34, the float 42 falls and unseats the needle valve 40, once again permitting fuel to enter. By virtue of this arrangement, the level of fuel in the fuel chamber 34 is maintained at a substantially constant level.

The fuel chamber 34 communicates with an air induction passage 44 having an interior wall 46. An inlet end 48 of the air induction passage 44 is open to the atmosphere, and an outlet end 50 communicates with the crankcase 22. A venturi 52 is located intermediate the inlet and outlet ends 48 and 50. Air is drawn from the atmosphere through the inlet end 48 and air induction passage 44 and into the combustion chamber 24 in response to pulsating pressure variations occasioned by piston 26 reciprocation.

The throttle means 18 is operative to control the volume of air which is drawn through the air induction passage 44. In this way, attainable engine speed is regulated. Specifically, a butterfly valve 54 having opposite end portions 56 is mounted in the air induction passage 44 intermediate the venturi 52 and the outlet end 50. The butterfly valve 54 is manually movable, such as in response to an accelerator pedal or throttle control lever (not illustrated), between a substantially closed position (shown in phantom lines as position A), a partially opened position (shown in phantom lines as position B), and a fully opened position (shown in solid lines as position C).

When the butterfly valve 54 is in the substantially closed position, one of the opposite ends 56 is held by a stop 58 or other similar means such that the other opposite end 56 is held in a close, non-touching relationship with the adjacent interior wall 46, thus defining a narrow gap 60 therebetween. When the butterfly valve 54 is in the substantially closed position (that is, position A in FIG. 1), air flow through the air induction passage 44 is substantially blocked, and only enough air to support engine 10 operation at the low speed is permitted through the narrow gap 60.

When the butterfly valve 54 is subsequently moved to the partially opened position (that is, position B in FIG. 1), more air is permitted to flow through the air induction passage 44, and engine operation at the intermediate speed is possible. Likewise, movement of the butterfly valve 54 to the fully opened position (that is, position C in FIG. 1) permits the substantial air flow required to support engine operation at the high speed.

As air flows through the air induction passage 44, fuel is drawn from the fuel chamber 34 into the air stream by suction created at predetermined points along the air induction passage 44. Specifically, the fuel delivery means 16 includes first fuel metering means 62 communicating with the fuel chamber 34 and the air induction passage 44 intermediate the bufferfly valve 54 and the outlet end 50, and being in close proximity to the narrow gap 60 defined when the butterfly valve 54 is in the substantially closed position (that is, position A in FIG. 1). The suction created in the gap 60 when the butterfly valve 54 is so disposed sucks fuel through the first fuel metering means 62 and into the air stream. However, when the butterfly valve 54 is subsequently moved into the partially and fully opened positions (that is, from position B to position C in FIG. 1), the suction force is substantially lessened, and little fuel is drawn through the first fuel metering means 62. Thus, the first fuel metering means 62 is primarily operative for discharging fuel when the engine 10 is operated at the low speed.

The fuel delivery means 16 also includes second fuel metering means 64 for discharging fuel into the air stream at the intermediate and high speeds. More particularly, the second fuel metering means 64 communicates with the fuel chamber 34 and the air induction passage 44 at the venturi 52. By virtue of the relatively narrow diameter of the interior wall 46 at the venturi 52, sufficient suction is created there when the butterfly valve 54 is disposed in the partially and fully open positions to draw fuel through the second fuel metering means 64 into the air stream.

While the first and second fuel metering means 62 and 64 may be variously constructed, in the illustrated embodiment, the second fuel metering means 64 includes a primary fuel supply passage 66 having a primary inlet end 68 communicating with the fuel chamber 34 and an open outlet end 70 which extends for a predetermined distance into the venturi 52. The first fuel metering means 62 includes a branch fuel supply passage 72 having a branch inlet end 74 communicating with the primary fuel supply passage 66 and an outlet end 76 flush with the interior wall 46.

To regulate the passage of fuel through the primary and branch fuel supply passages 66 and 72 in response to the suction created in the air induction passage 44, jets, which are essentially restrictions 78, 80, and 82 in the fuel supply passages 66 and 72, limit and control and quantity of fuel drawn through the passages 66 and 72 per unit of time and amount of suction. In particular, a first restriction 78 is located intermediate the primary inlet end 68 and the branch inlet end 74, which first restriction 78 limits and controls fuel flow through the second fuel metering means 64. Similarly, a second restriction 80 is located in the branch inlet end 74, and another restriction 82 is located in the outlet end 76 of the branch fuel supply passage 72. The first restriction 78 operates in combination with the second restriction 80 and the restriction 82 in the outlet end 76 to limit and control fuel flow through the first fuel metering means 62. As should be apparent, a more powerful suction is required to draw fuel through the first fuel metering means 62 than through the second fuel metering means 64, which more powerful suction occurs only at the narrow gap 60 created when the butterfly valve 54 is disposed in the substantially closed position (that is, position A in FIG. 1).

In the embodiment of the fuel delivery means 16 as heretofore described, limitations are imposed upon carburetor 32 adjustment, particularly with respect to the second fuel metering means 64. As the second fuel metering means 64 is operative during both intermediate and high speeds, it is difficult to obtain optimum fuel mixes at both speeds. As a result, fuel economy at the intermediate speed may sacrifice power at the high speed, and vice versa.

The fuel delivery means 16 further includes third fuel metering means 84 which is independent of the first and second metering means 62 and 64 and which is operative for discharging into the air stream fuel in addition to the fuel discharged by the second fuel metering means 64 when the engine 10 is being operated at the high speed.

While the construction of the third fuel metering means 84 can vary, in the illustrated embodiment, a tertiary fuel supply passage 86 has a tertiary inlet end 88 communicating with the fuel chamber 34 and a tertiary outlet end 90 which extends into the air induction passage 44 intermediate the inlet end 48 and the venturi 52.

To limit and control the quantity and initiation of fuel flow through the tertiary fuel supply passage 86, one or more air bleeds, or small apertures 92 and 93 may be used to partially vent the tertiary fuel supply passage 86 with the atmosphere. In addition, the tertiary outlet end 90 includes a restricted end portion defining a nozzle 94 having a fuel discharge opening 96 near the venturi 52.

The quantity of fuel which flows through the third fuel metering means 84 can be limited and controlled by varying the number and size of the air bleeds 92 and 93 along the tertiary fuel supply passage 86 or by other means. The location of the air bleeds 92 and 93 either in the air space of the fuel chamber 34, as air bleed 93 is located, or in the air induction passage 44, as air bleed 92 is located, also has an effect upon fuel flow. Air bleed 93 is subject to constant pressure within the fuel chamber 34, whereas air bleed 92 is subject to ever diminishing pressure as the air flow through the air induction passage 44 increases; thus, air bleed 93 is more effective than air bleed 92 in controlling the amount of fuel flowing through the third fuel metering means 84. In addition to varying the number, size, and placement of the air bleeds 92 and 93, the size of the fuel discharge opening 96 of the nozzle 94 may be varied to control the quantity of fuel flow. Thus, it is possible to vary the size of the first restriction 78 in the second metering means 64 to obtain optimum fuel economy at the intermediate speed, and to independently select the size of the discharge opening 96 and the size, number, and location of air bleeds 92 and 93 of the third fuel metering means 84 to maximize power at the high speed.

It is also possible to control the initiation of fuel flow through the third fuel metering means 84 by varying the size and quantity of air bleeds 92 and 93. As heretofore discussed, air bleed 92 is subject to ever decreasing pressure as air flow through the air induction passage 44 increases, as compared with the constant pressure at air bleed 93, and thus air bleed 92 is more effective than air bleed 93 to control fuel flow initiation. The size of the discharge opening 96 of the nozzle 94 also affects fuel flow initiation.

In addition, the horizontal and vertical position of the discharge nozzle 94 relative to the venturi 52 can control flow initiation through the third fuel metering means 84. Specifically, by increasing the horizontal distance between the venturi 52 and the discharge opening 96 of the nozzle 94, the initiation of flow is progressively delayed; that is, a higher volume of air is required to draw fuel through the third fuel metering means 84, which higher volume occurs only at higher engine 10 speeds. Also, by increasing the vertical distance of the discharge opening 96 of the nozzle 94 above the level of fuel in the fuel chamber 34, the initiation of flow is progressively delayed.

The horizontal and vertical displacement of the discharge nozzle 94 relative to the venturi 52 may be predetermined for optimum engine 10 operation at the high speed, and the placement of the tertiary fuel supply passage 86 in the air induction passage 44 may thus be fixed accordingly. In addition, the tertiary fuel supply passage 86 may be mounted in the air induction passage 44 such that the horizontal and vertical displacement of the discharge nozzle 94 may be adjusted. Furthermore, the discharge nozzle 94 may be adapted for removal and replacement by a more or less restricted nozzle 94.

Various of the features of the invention are set forth in the following claims.

What is claimed is:

1. A carburetor for an engine operative between a low speed, a high speed, and an intermediate speed between said low and said high speeds and including a combustion chamber, said carburetor including an air induction passage having an interior wall, an inlet end communicating with the atmosphere, an outlet end communicating with the combustion chamber, and a single venturi located intermediate said inlet and outlet ends, a butterfly valve having opposite end portions and being mounted in said air induction passage intermediate said venturi and said outlet end and being operable between a substantially closed position in which said opposite end portions are held in a close relationship relative to said interior wall for operating the engine at said low speed, a partially opened position for operating the engine at the intermediate speed, and a fully open position for operating the engine at the high speed, a fuel chamber, first fuel metering means for permitting passage of fuel from said fuel chamber to said induction passage when said butterfly valve is in said substantially closed position, and for constricting passage of fuel from said fuel chamber to said induction passage when said butterfly valve is in said partially open and said fully open positions, said first fuel metering means including an outlet port located in said induction passage interior wall intermediate said butterfly valve and said induction passage outlet and in close proximity to one of said butterfly valve opposite end portions when said butterfly valve is in said substantially closed position, a primary fuel passage having a primary inlet end communicating with said fuel chamber, a first fuel passage communicating with said outlet port and having an inlet end communicating with said primary fuel passage, a first flow restriction means intermediate said primary inlet end and said first fuel passage inlet end, and a second flow restriction means in said first fuel passage, second fuel metering means for constricting passage of fuel from said fuel chamber to said induction passage when said butterfly valve is in said substantially closed position, and for permitting passage of fuel from said fuel chamber to said induction passage when said butterfly valve is in said partially open and said fully open positions, said second metering means including a second fuel passage communicating with said primary fuel passage downstream of said first flow restriction means and having an outlet portion extending partially into said venturi for discharging fuel into said induction passage when said butterfly valve is in said partially open and fully open positions, and third fuel metering means for constricting passage of fuel from said fuel chamber to said induction passage when said butterfly valve is in said substantially closed and said partially open positions, and for permitting passages from said fuel chamber to said induction passage when said butterfly valve is in said fully open position of a quantity of fuel in addition to the fuel discharged by said second fuel metering means when said butterfly valve is in said fully open position, said third fuel metering means including a third fuel passage having an inlet end communicating with said fuel chamber independently of said primary fuel passage, and an outlet portion communicating with said air induction passage intermediate said venturi and said induction passage inlet end and adjacent said venturi, and air bleed means including at least one aperture in said third fuel passage intermediate said outlet portion and said third fuel passage inlet end, said aperture being adapted to partially vent said third fuel passage to the atmosphere.

2. A carburetor in accordance with claim 1 wherein said outlet portion of said third fuel passage includes a restricted discharge opening.

3. A carburetor in accordance with claim 1 wherein said outlet portion of said third fuel passage extends centrally into said air induction passage.

4. A carburetor for an engine operative between a low speed, a high speed, and an intermediate speed between said low and said high speeds and including a combustion chamber, said carburetor including an air induction passage having an interior wall, an inlet end communicating with the atmosphere, an outlet end communicating with the combustion chamber, and a single venturi located intermediate said inlet and outlet ends, a butterfly valve having opposite end portions and being mounted in said air induction passage intermediate said venturi and said outlet end and being operable between a substantially closed position in which said opposite end portions are held in a close relationship relative to said interior wall for operating the engine at said low speed, a partially opened position for operating the engine at the intermediate speed, and a fully open position for operating the engine at the high speed, a fuel chamber, first fuel metering means for permitting passage of fuel from said fuel chamber to said induction passage when said butterfly valve is in said substantially closed position, and for constricting passage of fuel from said fuel chamber to said induction passage when said butterfly valve is in said partially open and said fully open positions, said first fuel metering means including an outlet port located in said induction passage interior wall intermediate said butterfly valve and said induction passage outlet and in close proximity to one of said butterfly valve opposite end portions when said butterfly valve is in said substantially closed position, a primary fuel passage having a primary inlet end communicating with said fuel chamber, a first fuel passage communicating with said outlet port and having an inlet end communicating with said primary fuel passage, a first flow restriction means intermediate said primary inlet end and said first fuel passage inlet end, and a second flow restriction means in said first fuel passage, second fuel metering means for constricting passage of fuel from said fuel chamber to said induction passage when said butterfly valve is in said substantially closed position, and for permitting passage of fuel from said fuel chamber to said induction passage when said butterfly valve is in said partially open and said fully open positions, said second metering means including a second fuel passage communicating with said primary fuel passage downstream of said first flow restriction means and having an outlet portion extending partially into said venturi for discharging fuel into said induction passage when said butterfly valve is in said partially open and fully open positions, and third fuel metering means for constricting passage of fuel from said fuel chamber to said induction passage when said butterfly valve is in said substantially closed and said partially open positions, and for permitting passage from said fuel chamber to said induction passage when said butterfly valve is in said fully open position of a quantity of fuel in addition to the fuel discharged by said second fuel metering means when said butterfly valve is in said fully open position, said third fuel metering means including a third unvalved fuel passage having an inlet end communicating with said fuel chamber independently of said primary fuel passage, and an outlet portion communicating with said air induction passage intermediate said venturi and said induction passage inlet end and adjacent said venturi, and air bleed means including at least one aperture in said third fuel passage intermediate said outlet portion and said third fuel passage inlet end, said aperture being adapted to partially vent said third fuel passage to the atmosphere.

5. A carburetor in accordance with claim 4 wherein said outlet portion of said third fuel passage includes a restricted discharge opening.

6. A carburetor in accordance with claim 4 wherein said outlet portion of said third fuel passage extends centrally into said air induction passage.

* * * * *